US009917353B2

(12) United States Patent
Motomura et al.

(10) Patent No.: US 9,917,353 B2
(45) **Date of Patent: *Mar. 13, 2018**

(54) ROOF ANTENNA FOR VEHICLE

(71) Applicants: Kojima Industries Corporation, Toyota-shi, Aichi (JP); TOYOTA JIDOSHA KABUSHIKI KAISHA, Toyota-shi, Aichi-ken (JP)

(72) Inventors: Yusuke Motomura, Toyota (JP); Yuki Tomida, Toyokawa (JP)

(73) Assignees: KOJIMA INDUSTRIES CORPORATION, Toyota-Shi, Aichi (JP); TOYOTA JIDOSHA KABUSHIKI KAISHA, Toyota-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/094,076

(22) Filed: Apr. 8, 2016

(65) Prior Publication Data

US 2016/0315377 A1 Oct. 27, 2016

(30) Foreign Application Priority Data

Apr. 22, 2015 (JP) ..... 2015-087288

(51) Int. Cl.
*H01Q 1/32* (2006.01)
*H01Q 1/12* (2006.01)
(Continued)

(52) U.S. Cl.
CPC ..... *H01Q 1/3275* (2013.01); *H01Q 1/1214* (2013.01); *H01Q 1/42* (2013.01); *H01Q 21/28* (2013.01)

(58) Field of Classification Search
CPC ..... H01Q 1/3275; H01Q 1/1214
See application file for complete search history.

(56) References Cited

U.S. PATENT DOCUMENTS

2003/0068198 A1* 4/2003 Kozlovski ..... H01Q 1/1214 403/372
2004/0246196 A1 12/2004 Noro et al.
(Continued)

FOREIGN PATENT DOCUMENTS

JP 2004048599 A 2/2004
JP 2004363747 A 12/2004
(Continued)

OTHER PUBLICATIONS

Notice of Grounds for Rejection corresponding to Japanese Application No. 2015-087288; dated Apr. 25, 2017.
(Continued)

*Primary Examiner* — Daniel J Munoz
(74) *Attorney, Agent, or Firm* — Cantor Colburn LLP

(57) ABSTRACT

A roof antenna for a vehicle is provided having an antenna unit that receives radio waves, an antenna cover that covers the antenna unit, and an annular pad interposed between the antenna cover and the roof, wherein the pad includes a base that is retained at an inner side of a lower end of the antenna cover, an extension portion provided at a position opposing the lower end of the antenna cover, that extends from the base to an outer side of the lower end of the antenna cover, that can be tilted in a direction away from the lower end of the antenna cover, and that is formed from an elastic structure, and a lip formed at a tip of the extension portion and that is distanced from the outer side of the lower end of the antenna cover, and the extension portion is tilted to move away from the lower end of the antenna cover when a force in a direction away from the lower end of the antenna cover acts on the lip.

2 Claims, 4 Drawing Sheets

(51) Int. Cl.
*H01Q 1/42* (2006.01)
*H01Q 21/28* (2006.01)

(56) References Cited

U.S. PATENT DOCUMENTS

| | | | | |
|---|---|---|---|---|
| 2006/0097937 | A1* | 5/2006 | Gorai | H01Q 1/3275 343/713 |
| 2007/0046551 | A1* | 3/2007 | Tateno | H01Q 1/1214 343/713 |
| 2007/0075904 | A1* | 4/2007 | Blickle | H01Q 1/1214 343/715 |
| 2012/0081256 | A1 | 4/2012 | Aizawa et al. | |
| 2016/0020507 | A1* | 1/2016 | Kobayashi | H01Q 1/42 343/713 |

FOREIGN PATENT DOCUMENTS

| | | | |
|---|---|---|---|
| JP | 2012080388 | A | 4/2012 |
| JP | 2013229813 | A | 11/2013 |
| JP | 3189619 | U | 3/2014 |
| WO | 2013161520 | A1 | 10/2013 |
| WO | 2014136960 | A1 | 9/2014 |

OTHER PUBLICATIONS

USPTO Notice of Allowance corresponding to U.S. Appl. No. 15/094,042; dated Nov. 20, 2017.

* cited by examiner

ROOF ANTENNA FOR VEHICLE

PRIORITY INFORMATION

This application claims priority to Japanese Patent Application No. 2015-087288, filed on Apr. 22, 2015, the entire disclosure of which is incorporated herein by reference.

BACKGROUND

Technical Field

The present invention relates to a roof antenna for a vehicle, which is mounted on a roof of a vehicle.

Related Art

Various types of antennas exist as antennas to be mounted on a vehicle. As one of these antennas, roof antennas which are mounted on a roof of a vehicle are known. Because the roof antenna is mounted on a roof which is at the highest position of the vehicle body, a high reception sensitivity can be realized. As such a roof antenna, a roof antenna commonly called a "shark fin antenna" is known which is superior in compactness and design.

This roof antenna has an antenna unit in which elements, a circuit board, or the like are integrated, an antenna cover covering the antenna unit, and a pad which is formed from an elastic structure and which hides a gap between a lower end of the antenna cover and the roof (for example, JP 2013-229813 A).

Because the roof antenna is mounted on the roof, the design (fine appearance) thereof is important. Thus, the antenna cover and the pad must be accurately mounted on the roof. If the mounting position of the pad formed from the elastic structure is deviated, the pad may be entangled inside the antenna cover or pinched by the antenna cover, which result in mounting defects. In particular, because these entanglement and pinched portion stand out, the design is significantly degraded.

In order to inhibit the entanglement defect and pinching defect of the pad, a countermeasure may be taken to elongate a length of a lip forming an outer periphery of the pad. However, as the design is better with a narrower width of the lip, such a countermeasure would degrade the design. In addition, the extension of the length of the lip causes an increase in the amount of material used for the lip, which would consequently result in an increase in the cost.

Accordingly, an advantage of the present invention is in the provision of a roof antenna for a vehicle which reduces the mounting defect of the pad without increasing the cost.

SUMMARY

According to one aspect of the present invention, there is provided a roof antenna for a vehicle, mounted on a roof of a vehicle, comprising: an antenna unit that receives radio waves; an antenna cover that covers the antenna unit; and an annular pad interposed between the antenna cover and the roof, wherein the pad comprises: a base that is retained at an inner side of a lower end of the antenna cover; an extension portion provided at a position opposing the lower end of the antenna cover, that extends from the base to an outer side of the lower end of the antenna cover, that can be tilted in a direction away from the lower end of the antenna cover, and that is formed from an elastic structure; and a lip formed at a tip of the extension portion and that is distanced from the outer side of the lower end of the antenna cover, and the extension portion is tilted to move away from the lower end of the antenna cover when a force in a direction away from the lower end of the antenna cover acts on the lip.

According to another aspect of the present invention, preferably, the lip comprises an upper lip that extends from the tip of the extension portion in an upward direction and that covers the outer side of the lower end of the antenna cover, and a lower lip that extends from the tip of the extension portion in a downward direction and that is in contact with the roof.

According to various aspects of the present invention, the mounting defect of the pad can be reduced without increasing the cost.

DESCRIPTION OF EXEMPLARY EMBODIMENTS

Figure 1:
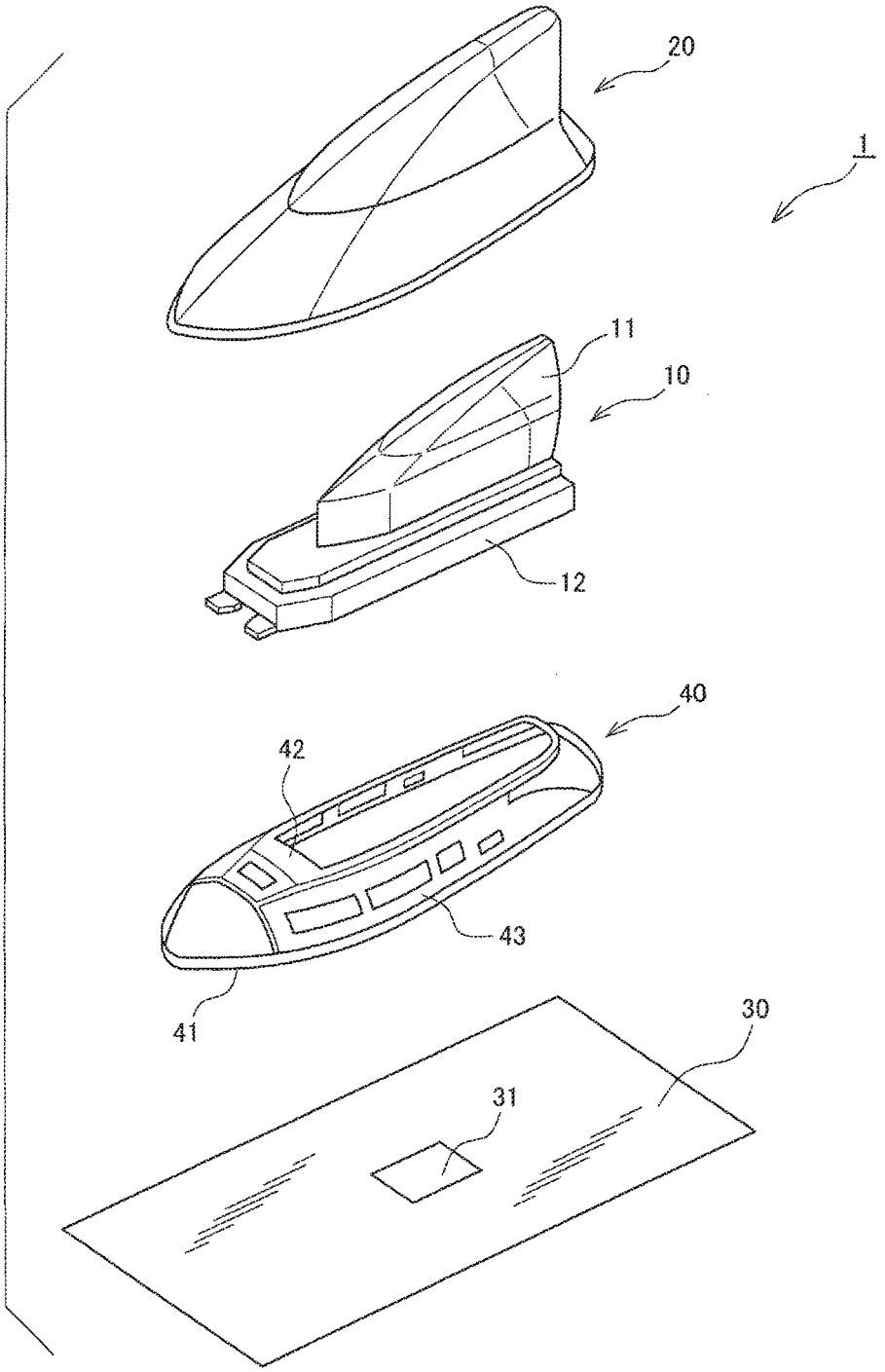
FIG. 1 is a detailed perspective view of a roof antenna.
Figure 2:
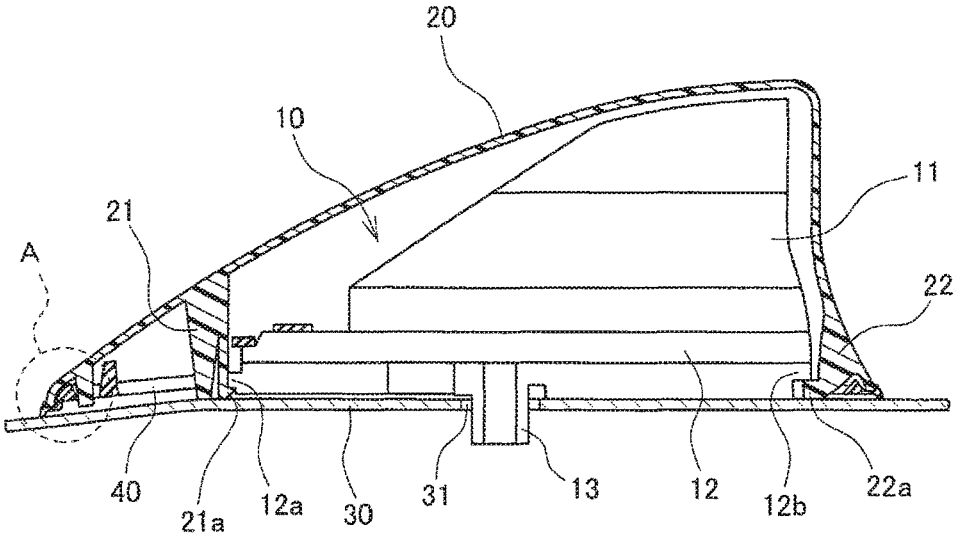
FIG. 2 is a cross sectional diagram of a roof antenna.

As shown in FIGS. 1 and 2, a roof antenna 1 to be mounted on a roof of a vehicle comprises an antenna unit 10 in which elements, a circuit board, or the like are integrated, an antenna cover 20 which covers the antenna unit 10, and a pad 40 which hides a gap between a lower end of the antenna cover 20 and a roof 30.

The antenna unit 10 has an antenna 11 which receives radio broadcast waves, digital television broadcast waves, and GPS radio waves, or the like, and an antenna board 12 which has a tuned circuit and an amplification circuit for the radio waves received by the antenna 11. On the antenna board 12, various antennas are equipped, and various antennas and the antenna board 12 are electrically connected to each other.

On a lower surface of the antenna board 12, a bolt fixation unit 13 which protrudes in the downward direction is formed. A screw is formed on a circumferential surface of the bolt fixation unit 13, and a nut (not shown) is screwed thereto. A center portion of the bolt fixation unit 13 has a hollow structure, and a cable from the antenna board 12 is placed through this portion. In addition, a hole 31 through which the bolt fixation unit 13 is inserted is formed on the roof 30.

On a front end and a rear end of the antenna board 12, engagement units 12*a* and 12*b* for attaching the antenna cover 20 are provided. In addition, a plurality of engagement units (not shown) are also provided at a side end of the antenna board 12.

The antenna 11 is constructed by unitizing an antenna element around which an enamel line for receiving the radio broadcast waves is wound, a metal, rod-shaped antenna for receiving the digital television broadcast waves, and a patch antenna for receiving the GPS radio waves.

The antenna cover 20 is made of a synthetic resin, and has a so-called shark fin shape in which a width is increased from a front tip toward the rear side, and the cover protrudes in a streamlined shape toward the rear side. Moreover, the antenna cover 20 has an annular lower end edge corresponding to the shape of the roof 30.

A storage space which can store the antenna unit 10 is formed inside the antenna cover 20. In the inside of the antenna cover 20, a rib 21 which protrudes from an inner surface of the antenna cover 20 in the downward direction is provided at a portion opposing the engagement unit 12*a* of the antenna board 12, and an engagement hook 21*a* which engages the engagement unit 12*a* is formed at a tip of the rib 21. At a rear end of the antenna cover 20, a thick portion 22 is provided at a portion opposing the engagement unit 12*b* of the antenna board 12, and an engagement hook 22*a* which engages the engagement unit 12*b* is formed at an inner side of the thick portion 22. In addition, a plurality of engagement hooks (not shown) which engage the pad 40 are provided inside the antenna cover 20.

Figure 4:
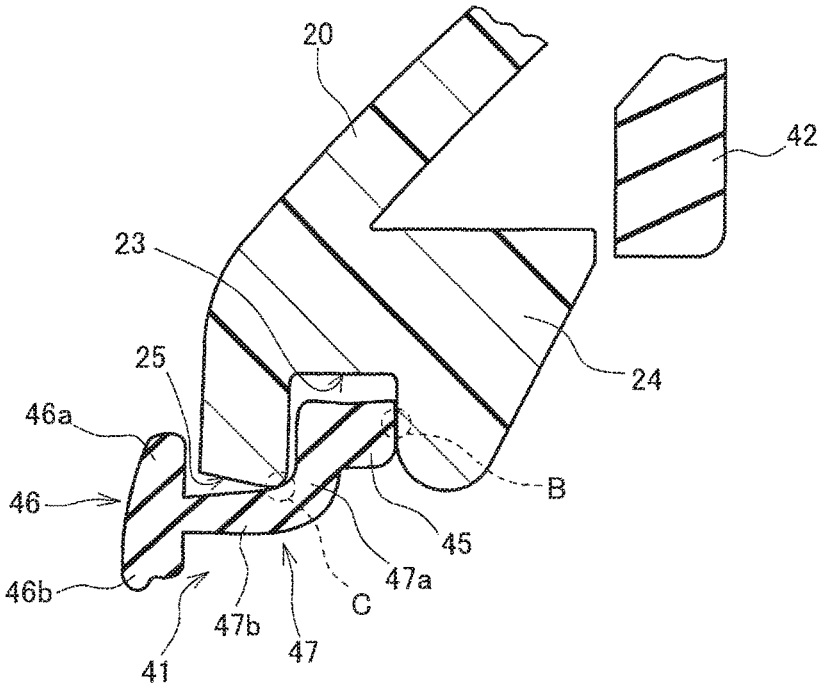
FIG. 4 is an enlarged cross sectional diagram showing an assembly state of an antenna cover and a pad.

As shown in FIG. 4, a retaining unit 23 which retains the pad 40 is formed on a lower end edge of the antenna cover 20. The retaining unit 23 has a recessed shape opened in the downward direction, and retains a base 45 of the pad 40 (to be described later) with the recess. In addition, an engagement unit 24 which engages an inner ring section 42 of the pad 40 is formed at an inner side of the retaining unit 23.

Figure 3:
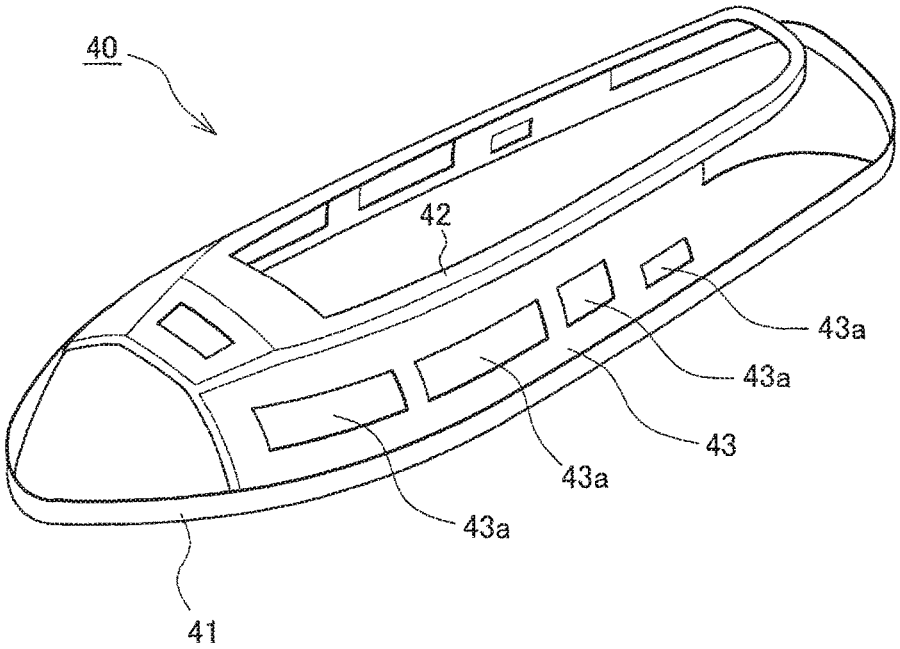
FIG. 3 is an enlarged perspective view of a pad.

As shown in FIG. 3, the pad 40 has an annular outer ring section 41 formed by an elastic member such as elastomer and which contacts a lower end edge of the antenna cover 20, the inner ring section 42 formed at an inner side of the outer ring section 41 and which contacts an upper surface of the antenna board 12, and a connection unit 43 which connects the outer ring section 41 and the inner ring section 42 at a plurality of locations.

The connection unit 43 is formed from a side wall sloped from an edge of the inner ring section 42 toward the outer ring section 41, and a plurality of holes 43*a* are formed at portions which interfere with the antenna board 12. In addition, an engagement unit to which an engagement hook (not shown) provided inside the antenna cover 20 engages is provided in the connection unit 43.

Figure 5:
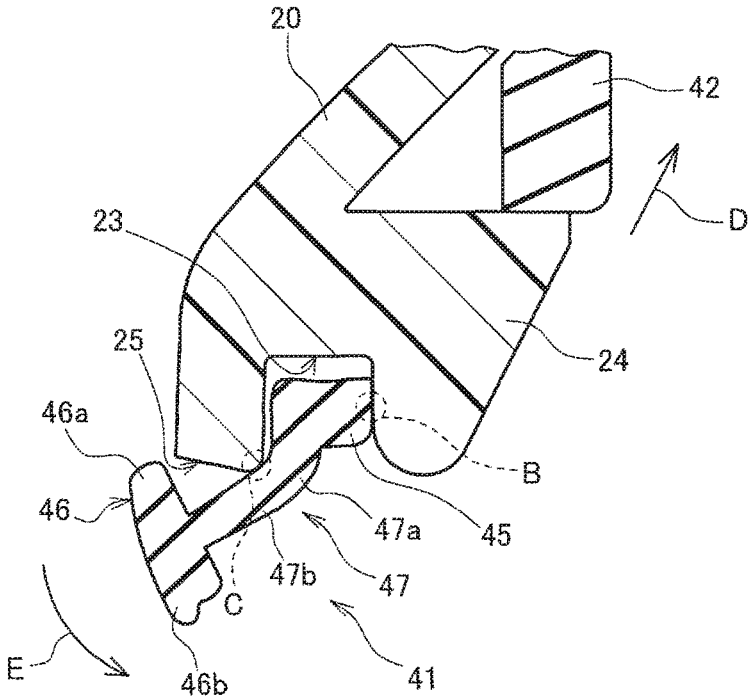
FIG. 5 is an enlarged cross sectional diagram showing a lifted state of an antenna cover and a pad after assembly.
Figure 6:
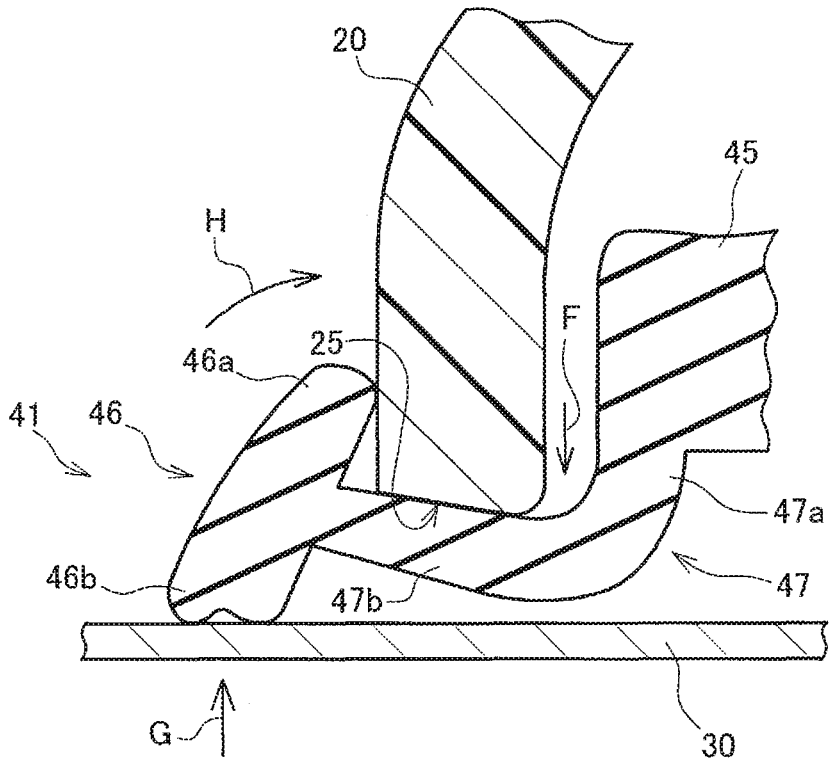
FIG. 6 is an enlarged cross sectional diagram showing a mounting state of an antenna cover and a pad on a roof.

FIGS. 4-6 show an enlarged view of a part A in FIG. 2. As shown in FIGS. 4-6, the outer ring section 41 comprises the base 45 which primarily forms the annular portion of the outer ring section 41, a lip unit 46 which contacts the antenna cover 20 and the roof 30 and covers the gap when the antenna cover 20 is mounted on the roof 30, and a lip retaining unit 47 which retains the lip unit 46 on the base 45. The base 45, the lip unit 46, and the lip retaining unit 47 are formed over the entire circumference of the outer ring section 41.

The base 45 has an approximately rectangular cross sectional shape, and an inner circumferential surface extending toward the inner side of the outer ring section 41 is in contact with the retaining unit 23 of the antenna cover 20 (shown in FIG. 4 with reference letter B). The lip retaining unit 47 includes a protruding portion 47*a* which protrudes from a lower surface of the base 45 in a downward direction, and an extension portion 47*b* which is bent in an approximate right angle from the tip of the protruding portion 47*a* toward an outer circumference of the outer ring section 41 and extends from the bent portion. An end surface 25 of a lower end edge of the antenna cover 20 is in contact with an upper surface of the extension portion 47*b* (shown in FIG. 4 with reference letter C).

The extension portion 47*b* has a length longer than a thickness of the lower end edge of the antenna cover 20. In other words, the tip of the extension portion 47*b* is positioned at a side that is further out than the outer circumferential surface of the antenna cover 20. A lip unit 46 having an approximately triangular cross section with an acute angle at the top is provided at the tip of the extension portion 47*b*. The tip of the extension portion 47*b* is connected to an approximate center portion in the up-and-down direction of the lip unit 46. The lip unit 46 includes an upper lip 46*a* which extends from the connection portion of the extension portion 47*b* in the upward direction, and a lower lip 46*b* which extends from the connection portion of the extension portion 47*b* in a downward direction. In a state before the antenna cover 20 is mounted on the roof 30, an inner side surface of the upper lip 46*a* is distanced from the outer circumferential surface of the lower end edge of the antenna cover 20.

The retaining of the lip unit 46 by the extension portion 47*b* will now be described. A force with which the lip unit 46 is retained by the extension portion 47*b* (rigidity) is set to be approximately equal to the force for retaining the weight of the lip unit 46. In other words, the components are set such that, in a state where no external force acts on the lip unit 46, the extension portion 47*b* retains the lip unit 46 in a stationary state, but when an external force acts on the lip unit 46 in a downward direction, the extension portion 47*b* would not be able to maintain the stationary state of the lip unit 46 due to the external force, and the extension portion 47*b* is elastically deformed to bend downward. Alternatively, a setting may be employed in which, even without an external force, the extension portion 47*b* is slightly bent downward by the weight of the lip unit 46 alone.

As shown in FIG. 4, the extension portion 47*b* is formed in a tapered shape such that the cross sectional shape thereof is narrowed toward the lip unit 46, and the rigidity of the extension portion 47*b* is adjusted by adjusting the tapered shape. Alternatively, a thickness of the extension portion 47*b* may be adjusted to adjust the rigidity of the extension portion 47*b*.

Next, assembly of the roof antenna 1 will be described. First, various constituent components of the antenna unit 10 such as the antenna 11 and the antenna board 12 are assembled to unitize the components, and form the antenna unit 10. The antenna board 12 of the unitized antenna unit 10 is passed through an inner side of the inner ring section 42 of the pad 40 to assemble the pad 40 onto the antenna unit 10. Alternatively, the antenna unit 10 may be passed through the inner side of the inner ring section 42 of the pad 40 from an upper part of the antenna unit 10, to assemble the pad 40 onto the antenna unit 10.

When the pad 40 is assembled to the antenna unit 10, the pad 40 and the antenna unit 10 are assembled by combining the inner ring section 42 of the pad 40 and the upper surface of the antenna unit 10. Then, the antenna cover 20 is assembled in a manner to cover the antenna unit 10 from above the antenna unit 10.

The engagement hooks 21*a* and 22*a* of the antenna cover 20 and the engagement hooks which engage the pad 40 respectively engage the engagement units 12*a* and 12*b* of the antenna board 12 and the engagement unit of the pad 40, so that the antenna cover 20, the antenna unit 10, and the pad 40 are integrated and the unit of the roof antenna 1 is completed.

Assembly of the antenna cover 20 and the pad 40 will now be described in detail. As shown in FIG. 4, the base 45 of the outer ring section 41 and the retaining unit 23 of the antenna cover 20 are aligned, and the base 45 is fitted to the retaining unit 23. In addition, the engagement unit 24 of the antenna cover 20 and the inner ring section 42 of the pad 40 are engaged to attach the pad 40 and the antenna cover 20 with each other. In this process, the outer ring section 41 is supported on the antenna cover 20 by a portion of the base 45 in contact with the retaining unit 23 (reference letter B in the figure) and a portion of the extension portion 47*b* in contact with the end surface 25 of the lower end edge of the antenna cover 20 (reference letter C in the figure).

Then, as shown in FIG. 5, the unitized roof antenna 1 is temporarily lifted upward from this state, as shown by an arrow D in the figure. With this lifting, a force due to the lifting would act on the lip unit 46, it becomes difficult for the extension portion 47*b* to maintain the lip unit 46 in the stationary state, the extension portion 47*b* is elastically deformed with the portion of reference numeral C in the figure as a base point, and the lip unit 46 is tilted as shown by an arrow E in the figure.

Because of this, the lip unit 46 and the lower end edge of the antenna cover 20 are temporarily distanced from each other, and occurrence of pinching or entanglement is inhibited. Even if the upper lip 46*a* of the lip unit 46 is pinched or entangled by the lower end edge of the antenna cover 20 when the pad 40 and the antenna cover 20 are assembled, the lip unit 46 is tilted by the lifting operation, and the lip unit 46 and the lower end edge of the antenna cover 20 are temporarily distanced by the tilting operation, resolving the pinching and entanglement.

When the lifting operation is stopped, the lip unit 46 returns to a normal position, and the unitized roof antenna 1 is placed on the roof 30 while maintaining this state. The bolt fixation unit 13 of the antenna unit 10 is inserted into the hole 31 formed in the roof 30, and the roof antenna 1 is fixed on the roof 30 by a nut (not shown).

As shown in by an arrow F FIG. 6, with this fixation, the end surface 25 of the lower end edge of the antenna cover 20 presses the extension portion 47*b*. With the extension portion 47*b* being elastically deformed to curve in the downward direction, the lower lip 46*b* is pushed against the roof 30 and closely contacts the roof 30. By a reaction force received by the lower lip 46*b* from the roof 30 (arrow G in the figure), the upper lip 46*a* is tilted toward the outer circumferential surface of the lower end edge of the antenna cover 20 as shown by an arrow H in the figure, and the upper lip 46*a* is pushed and closely contacts the outer circumferential surface. As a result, the region between the lower end edge of the antenna cover 20 and the roof 30 is covered by the lip unit 46.

As described, even if the upper lip 46*a* of the lip unit 46 is pinched or entangled by the lower end edge of the antenna cover 20, with the lifting operation of the unitized roof antenna 1, the lip unit 46 is tilted downward, and the lip unit 46 and the lower end edge of the antenna cover 20 are temporarily distanced. As a result, the pinching and entanglement are resolved and the lip unit 46 is returned to the normal position. Because of this, the mounting defect of the pad 40 can be reduced and the design (fine appearance) is not degraded. Further, because it is not necessary to elongate the length of the upper lip 46*a* or to increase the amount of material of the lip unit 46, the increase in the cost can also be inhibited.

What is claimed is:

1. A roof antenna for a vehicle, mounted on a roof of a vehicle, comprising:

an antenna unit that receives radio waves;

an antenna cover that covers the antenna unit; and an annular pad interposed between the antenna cover and the roof, wherein the pad comprises:

a base that is retained at an inner side of a lower end of the antenna cover;

an extension portion provided at a portion opposing the lower end of the antenna cover, that extends from the base to an outer side of the lower end of the antenna cover, that can be tilted in a direction away from the lower end of the antenna cover, and that is formed from an elastic structure; and a lip formed at a tip of the extension portion and that is distanced from the outer side of the lower end of the antenna cover, and the extension portion is tilted to move away from the lower end of the antenna cover when a force in a direction away from the lower end of the antenna cover acts on the lip, wherein a retaining unit which is an inner space is defined in a surface of the lower end of the antenna cover and is defined by protruding portions of the lower end of the antenna cover which protrude towards the roof such that an inner surface of the base retained in the retaining unit contacts one of the protruding portions when the other of the protruding portions contacts an upper surface of the extension portion.

2. The roof antenna for vehicle according to claim 1, wherein the lip comprises an upper lip that extends from the tip of the extension portion in an upward direction and that covers the outer side of the lower end of the antenna cover, and a lower lip that extends from the tip of the extension portion in a downward direction and that is in contact with the roof.

* * * * *